US011137228B1

(12) United States Patent
Chang

(10) Patent No.: US 11,137,228 B1
(45) Date of Patent: Oct. 5, 2021

(54) CROSSBOW

(71) Applicant: Combis Sport Enterprise Co., Ltd., Taichung (TW)

(72) Inventor: Chu-Wei Chang, Taichung (TW)

(73) Assignee: Combis Sport Enterprise Co., Ltd., Taichung (TW)

( * ) Notice: Subject to any disclaimer, the term of this patent is extended or adjusted under 35 U.S.C. 154(b) by 0 days.

(21) Appl. No.: 17/108,164

(22) Filed: Dec. 1, 2020

(51) Int. Cl.
*F41B 5/12* (2006.01)

(52) U.S. Cl.
CPC ..... *F41B 5/123* (2013.01)

(58) Field of Classification Search
CPC .... F41B 5/12; F41B 5/123; F41B 5/14; F41B 5/1403
USPC ..... 124/25
See application file for complete search history.

(56) References Cited

U.S. PATENT DOCUMENTS 2,842,114 A * 7/1958 Duncan ..... F41B 5/12 124/25
4,294,222 A * 10/1981 Pelsue ..... F41B 5/12 124/25
4,545,358 A * 10/1985 Collins ..... F41B 5/12 124/25
4,587,944 A * 5/1986 Barnett ..... F41B 5/12 124/25
5,522,373 A * 6/1996 Barnett ..... F41B 5/12 124/23.1
5,553,596 A * 9/1996 Bednar ..... F41B 5/12 124/25
8,042,530 B2 * 10/2011 Barnett ..... F41B 5/12 124/25
9,121,659 B1 * 9/2015 Chang ..... F41B 5/14
9,341,430 B2 * 5/2016 McPherson ..... F41B 5/123
9,347,731 B1 * 5/2016 Chang ..... F41B 5/123
9,689,639 B1 * 6/2017 Liu ..... F41B 5/12
10,139,190 B1 * 11/2018 Trpkovski ..... F41A 11/00
10,267,592 B2 * 4/2019 Bartels ..... F41B 5/123
10,520,273 B2 * 12/2019 Bednar ..... F41B 5/12
10,663,248 B1 * 5/2020 Liu ..... F41B 5/123
10,830,553 B2 * 11/2020 Egerdee ..... F41B 5/12
10,969,191 B2 * 4/2021 Wong ..... F41B 5/14
2014/0283805 A1 * 9/2014 Dunlop ..... F41B 5/1403 124/25
2020/0191518 A1 * 6/2020 Egerdee ..... F41B 5/12
2020/0370856 A1 * 11/2020 Trpkovski ..... F41B 5/0094

* cited by examiner

*Primary Examiner* — Alexander R Niconovich
(74) *Attorney, Agent, or Firm* — Karin L. Williams; Alan D. Kamrath; Mayer & Williams PC

(57) ABSTRACT

A crossbow includes a barrel, a tube, a threaded bolt, a riser, a mount, a cam and a handle. The tube is connected to the barrel. The threaded bolt includes a head and is engaged with the tube to provide a gap between the head and the tube. The mount extends from the riser, and includes an aperture for receiving the tube and a recess for receiving the tube and the threaded bolt so that the gap is located in the rear recess. The cam is movable in the recess and includes an extensive portion and a space for receiving the tube. The handle assembly is pivotally connected to the mount and the cam so that the handle assembly is operable to move the cam in the recess of the mount to insert the extensive portion of the cam in the gap to keep the connection mechanism in the aperture.

10 Claims, 17 Drawing Sheets

CROSSBOW

BACKGROUND OF INVENTION

1. Field of Invention

The present invention relates to a crossbow and, more particularly, to a crossbow that can be assembled and disassembled fast.

2. Related Prior Art

Referring to FIGS. 15 through 18, a conventional crossbow 90 includes a barrel 91, a riser 92 connected to a front end of the barrel 91, four limbs (not numbered) connected to the riser 92, two wheels (not numbered) connected to the limbs and a string (not shown) connected to the wheels. A tube 932 and a threaded bolt 934 are used to connect the riser 92 to the front section of the barrel 91.

A section of the tube 932 is inserted in the barrel 91. Several screws A are used to keep the section of the tube 932 in the barrel 91. Each of the screws A includes a sharp end inserted in the tube 932 and a flat end located on the barrel 91.

The riser 92 is formed with an aperture 922 that includes a wide section (not numbered), a narrow section (not numbered) and a shoulder (not numbered) between the wide and narrow sections. Another section of the tube 932 is inserted in wide section of the aperture 922. The threaded bolt 934 is inserted in the narrow section of the aperture 922. The threaded bolt 934 is inserted in and engaged with the tube 932. Thus, the riser 92 is connected to the front end of the barrel 91.

As described above, the riser 92, the limbs and the string can be connected to the barrel 91. However, this process is not good for reducing the size of the crossbow. The riser 92 and the limbs extend transversely relative to the barrel 91 and hence increase a transverse dimension of the crossbow. This is not good for a user to carry the crossbow around in woods or a limited space. Hence, it is desirable to detach the riser 92 and the limbs from the barrel 91 when the crossbow is not in operation. However, a screw driver or an Allen key must be used to disengage the threaded bolt 934 from the tube 932 before the riser 92 and the limbs can be detached from the barrel 91. Moreover, it requires care to keep the threaded bolt 934. The crossbow cannot be used if the threaded bolt 934 is lost.

The present invention is therefore intended to obviate or at least alleviate the problems encountered in the prior art.

SUMMARY OF INVENTION

It is the primary objective of the present invention to provide a crossbow with a quick-release mechanism for connecting limbs to a barrel.

To achieve the foregoing objective, the crossbow further includes a riser, a tube and a threaded bolt, and the quick-release mechanism includes a mount, a cam and a handle. The limbs are connected to the riser. The tube is connected to the barrel. The threaded bolt includes a head and is engaged with the tube to provide a gap between the head and the tube. The mount extends from the riser, and includes an aperture for receiving the tube and a recess for receiving the tube and the threaded bolt so that the gap is located in the rear recess. The cam is movable in the recess and includes an extensive portion and a space for receiving the tube. The handle assembly is pivotally connected to the mount and the cam so that the handle assembly is operable to move the cam in the recess of the mount to insert the extensive portion of the cam in the gap to keep the connection mechanism in the aperture.

Other objectives, advantages and features of the present invention will be apparent from the following description referring to the attached drawings.

BRIEF DESCRIPTION OF DRAWINGS

The present invention will be described via detailed illustration of the preferred embodiment versus the prior art referring to the drawings wherein.

DETAILED DESCRIPTION OF PREFERRED EMBODIMENT

Figure 16:
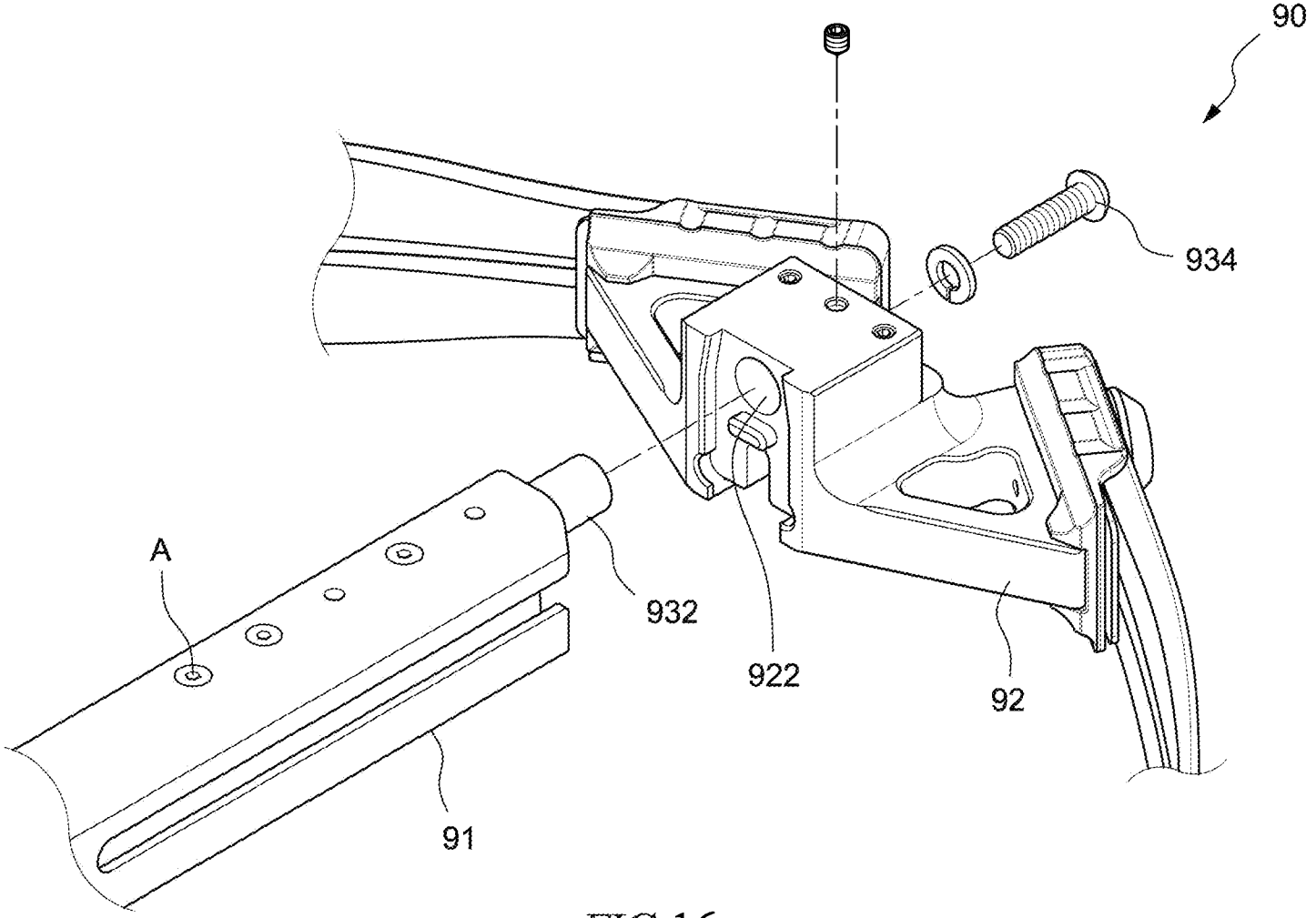
PRIOR ART FIG.16
FIG. 16 is an exploded view of the crossbow shown in FIG. 15.
Figure 17:
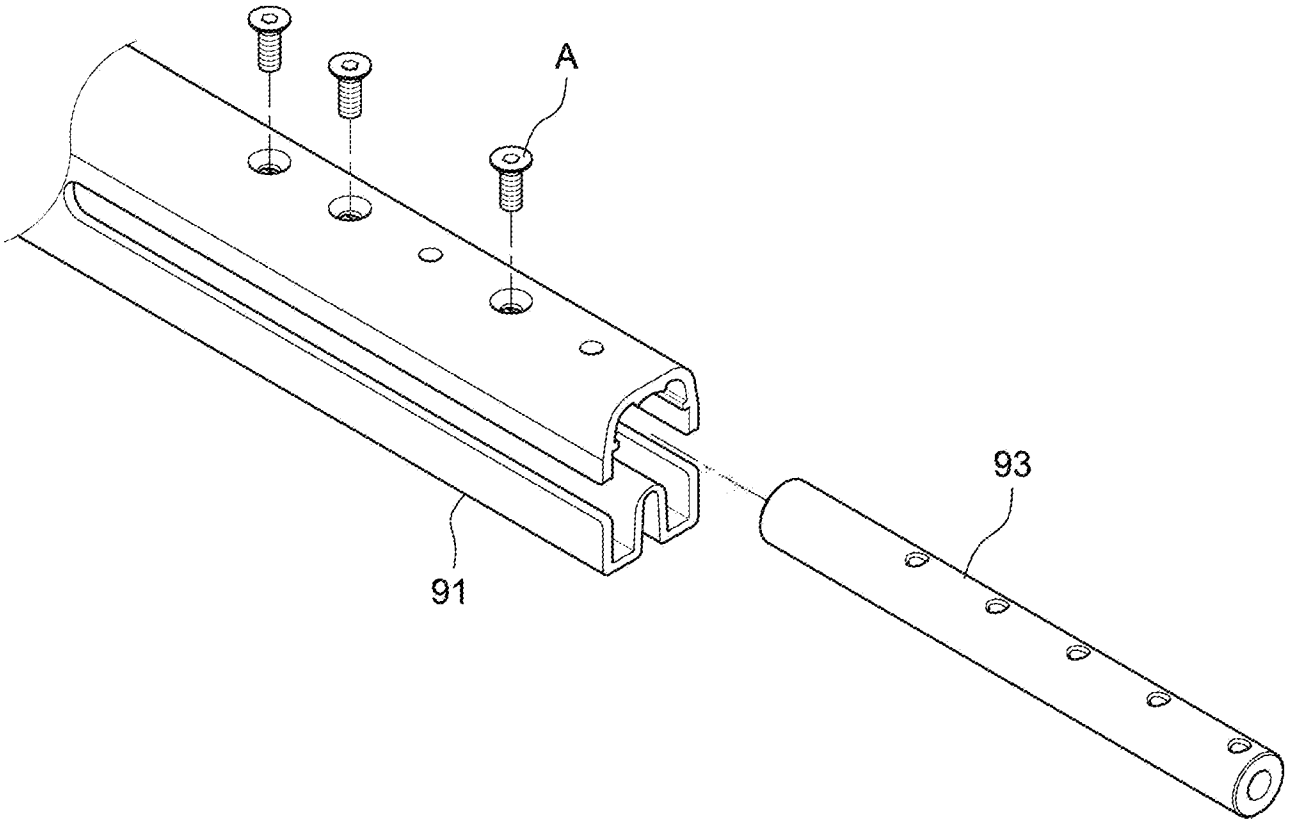
FIG.17 PRIOR ART
FIG. 17 is an enlarged partial and exploded view of the crossbow shown in FIG. 16.
Figure 18:
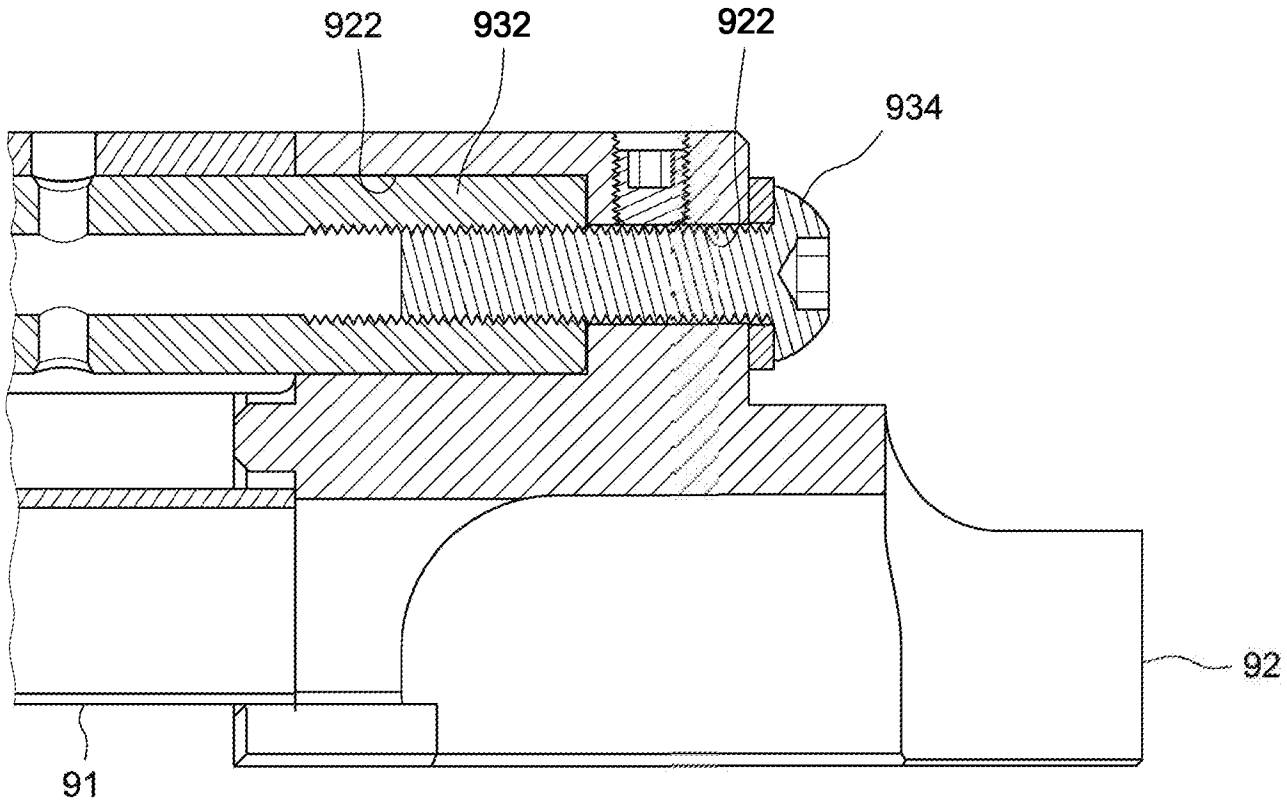
FIG.18 PRIOR ART
FIG. 18 is a cross-sectional view of the crossbow shown in FIG. 15.

Referring to FIGS. 1 to 5, a crossbow includes a barrel 11, a trigger 12, a riser 13, a string 14, four limbs 16, two wheels 18 and a tube 932 like the conventional crossbow described in the RELATED PRIOR ART referring to FIGS. 16 to 18. The trigger 12 is connected to the barrel 11. The riser 13 is attached to the barrel 11. The limbs 16 are grouped into two left limbs 16 and two right limbs 16. The left limbs 16 are connected to a left side of the riser 13. The right limbs 16 are connected to a right side of the riser 13. One of the wheels 18 is supported on the left limbs 16. The remaining one of the wheels 18 is supported on the right limbs 16. The string 14 is supported on the wheels 18. The tube 932 includes a rear section inserted in and connected to the barrel 11 by screws and a front section extending out of the barrel 11.

The crossbow further includes a connection mechanism 20, a mount 30, pushers 40, a cam 50 and a handle assembly 60 according to the preferred embodiment of the present invention.

Figure 1:
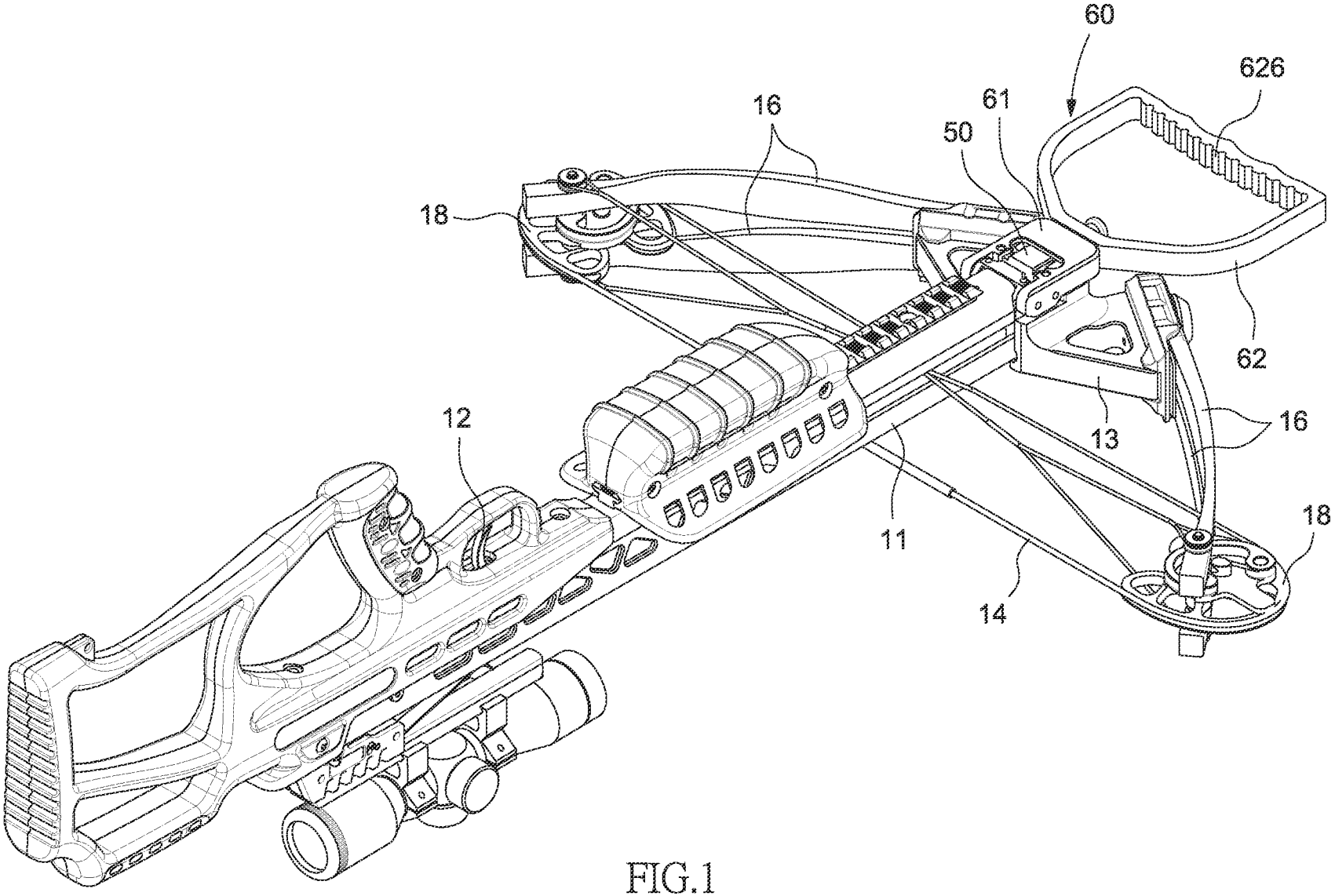
FIG. 1 is a perspective view of a crossbow according to the preferred embodiment of the present invention.
Figure 2:
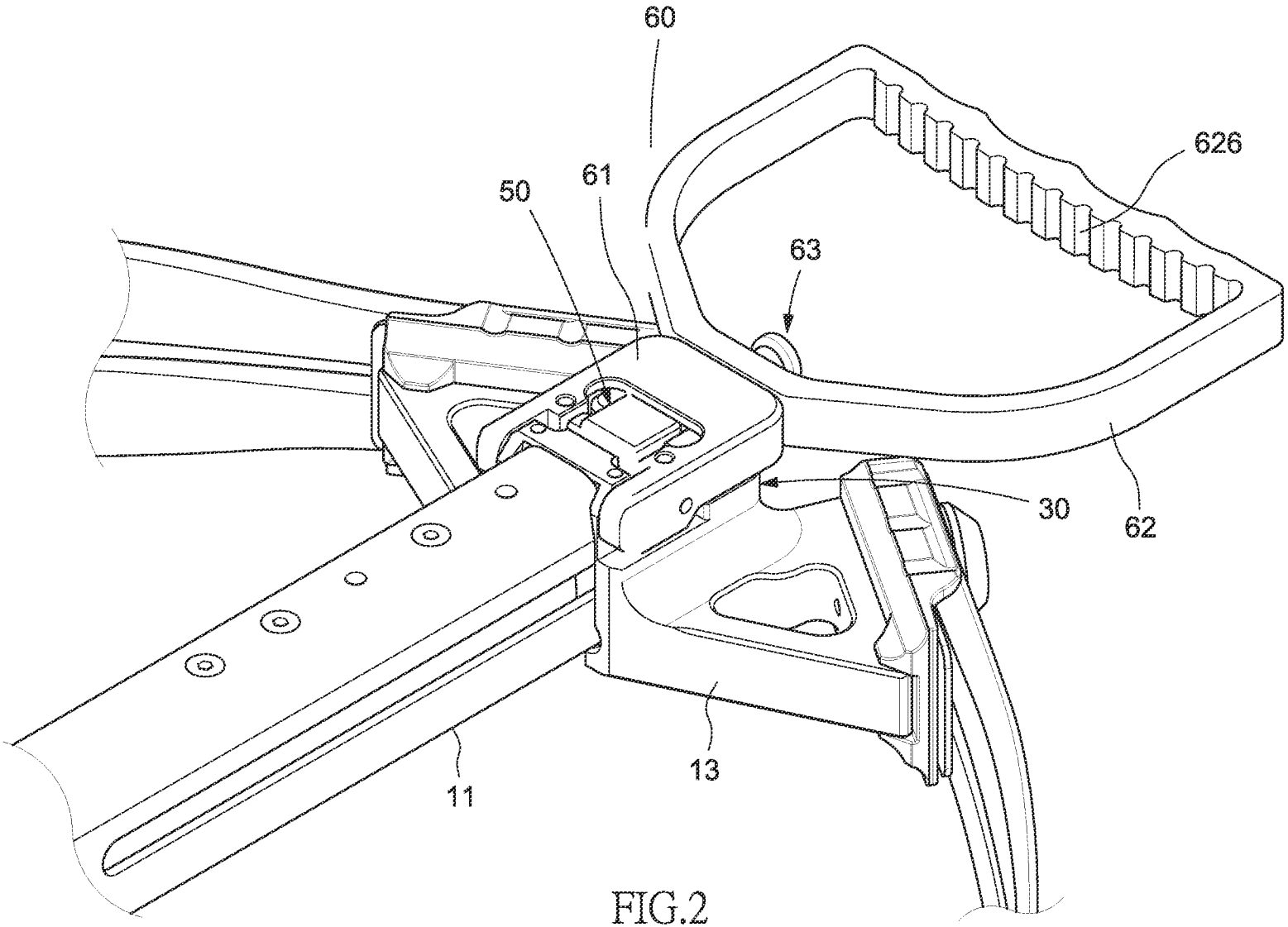
FIG. 2 is an enlarged partial view of the crossbow shown in FIG. 1.
Figure 3:
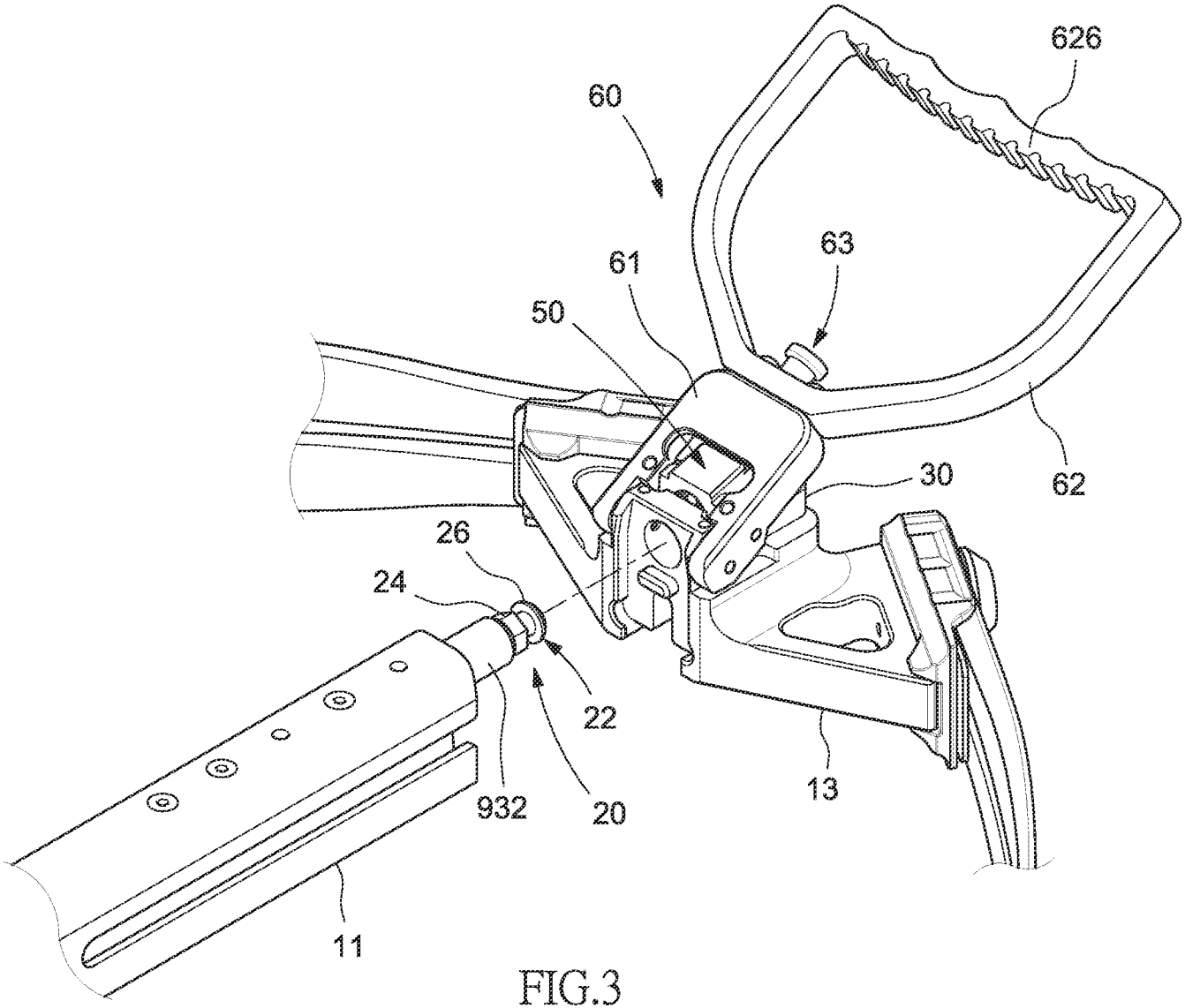
FIG. 3 is an exploded view of the crossbow shown in FIG. 2.
Figure 4:
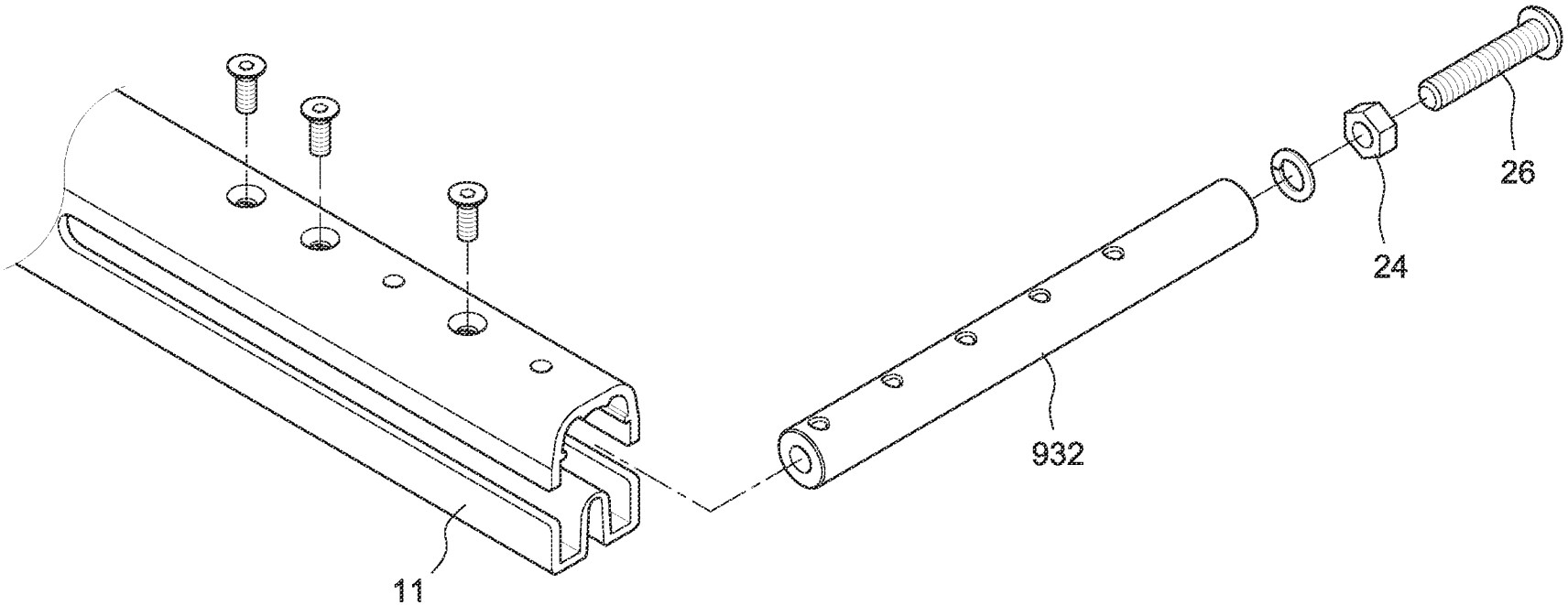
FIG. 4 is an enlarged partial and exploded view of the crossbow shown in FIG. 3.

Referring to FIGS. 3 and 4, the connection mechanism 20 includes a nut 24 and a threaded bolt 26. The nut 24 is engaged with the threaded bolt 26 so that there is a gap 22 between the nut 24 and a head of the threaded bolt 26. The threaded bolt 26 is inserted in and engaged with the tube 932. The nut 24 is abutted against the tube 932 to adjust the size of the gap 22.

Referring to FIGS. 2, 3, 5 and 6, the mount 30 is formed on the riser 13. Preferably, the mount 30 and the riser 13 are made in one piece. The mount 30 includes a rear protuberance, a front protuberance, a rear aperture 31, a front aperture 32, a recess 33, several lateral apertures 34, and several bores 35. The rear protuberance is separated from the front protuberance.

Figure 9:
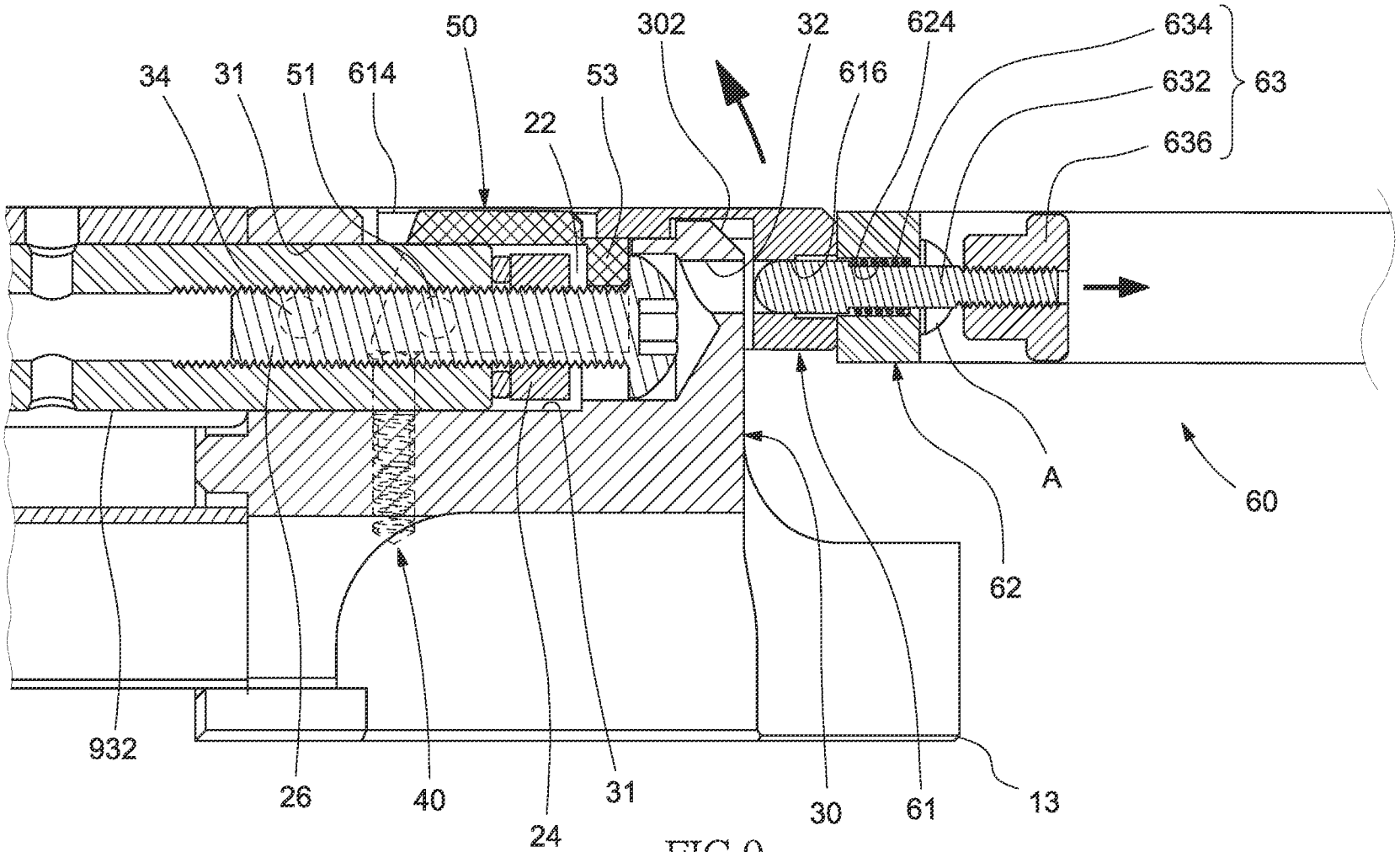
FIG. 9 is a cross-sectional view of the crossbow shown in FIG. 2.

The rear aperture 31 is made in the rear protuberance of the mount 30. The rear aperture 31 extends parallel to the barrel 11 when the riser 13 is connected to the barrel 11. The front section of the tube 932 extends through the rear aperture 31 (FIG. 9).

The front aperture 32 is made in a front protuberance of the mount 30. The front aperture 32 extends parallel to the barrel 11 when the riser 13 is connected to the barrel 11.

A slope 302 is formed on the front protuberance of the mount 30. The front aperture 32 is located between the rear aperture 31 and the slope 302.

The recess 33 is made in the front protuberance of the mount 30. The recess 33 is in communication with the front aperture 32 and the rear aperture 31. The recess 33 is located corresponding to the gap 22.

The lateral apertures 34 are made in two sides of the rear protuberance of the mount 30. Preferably, the lateral apertures 34 are in communication with the rear aperture 31.

The bores 35 extend vertically. The bores 35 are located between the rear and front protuberances of the mount 30.

Figure 5:
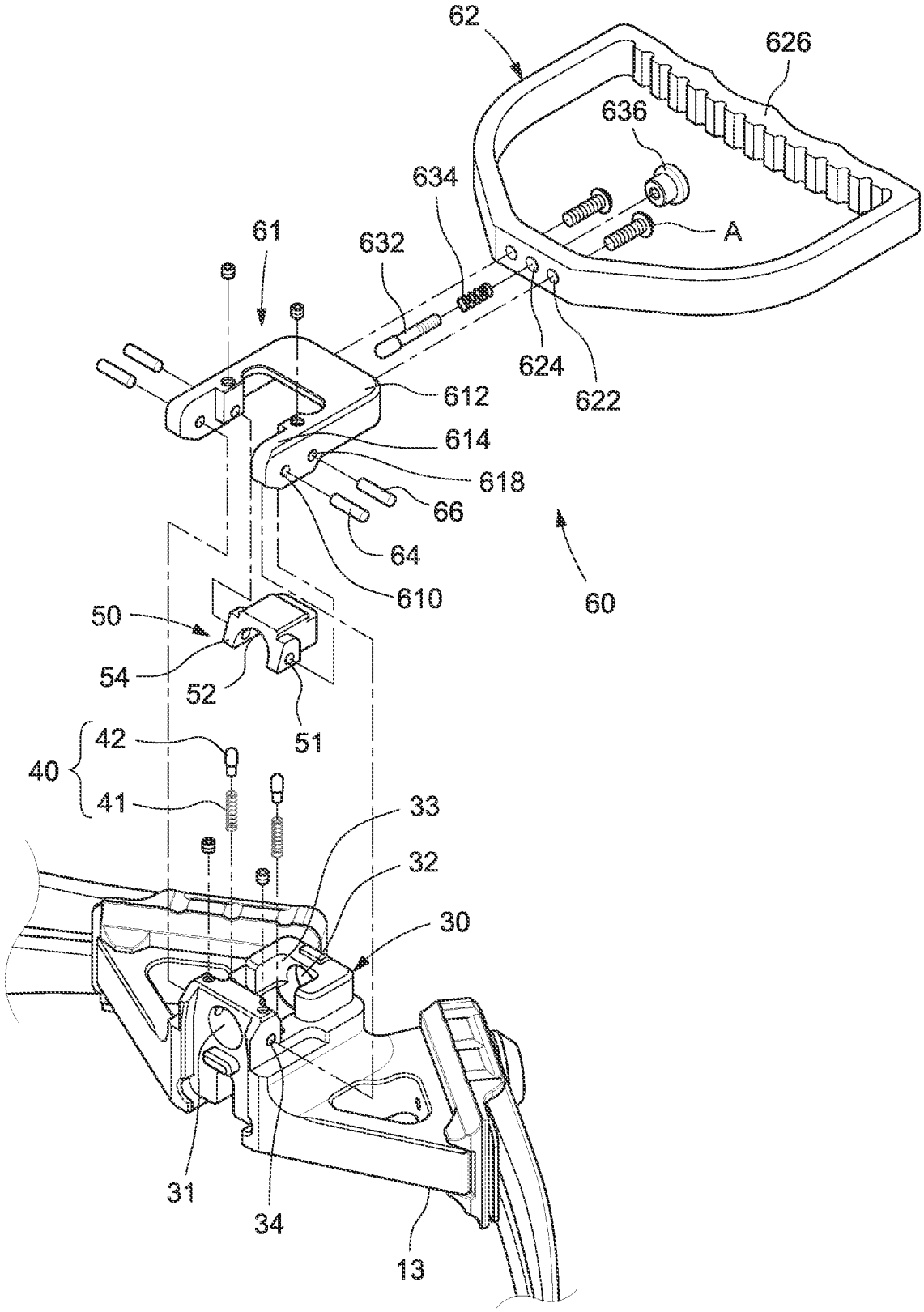
FIG. 5 is an exploded view of the crossbow shown in FIG. 2.
Figure 6:
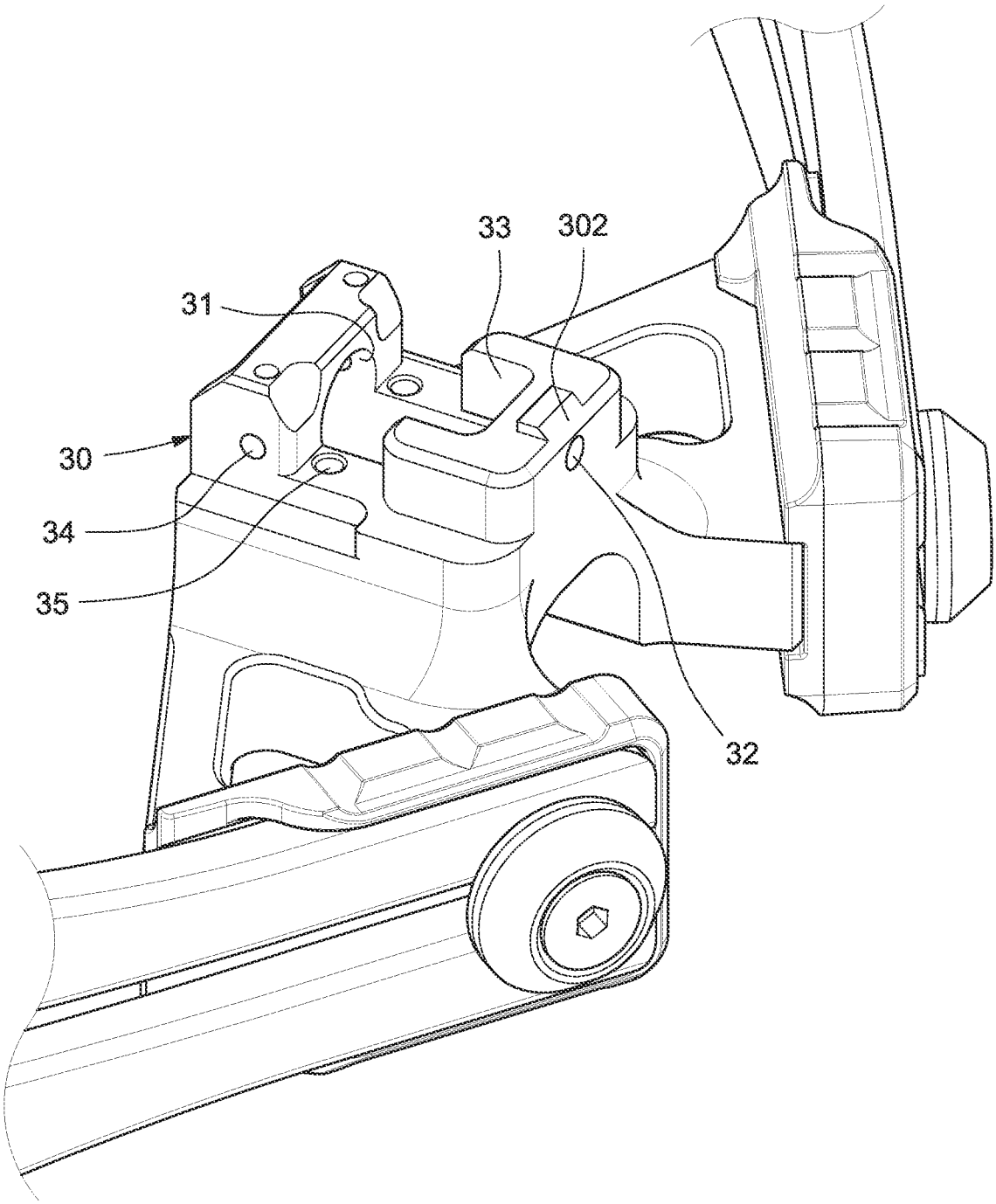
FIG. 6 is an enlarged perspective view of a mount of the crossbow shown in FIG. 5.

Referring to FIGS. 5 and 6, each of the pushers 40 includes a spring 41 and a rod 42. The spring 41 of each of the pushers 40 is inserted in a corresponding one of the bores 35. A section of the rod 42 of each of the pushers 40 is fitted in the corresponding spring 41 and inserted in a corresponding one of the bores 35.

Figure 7:
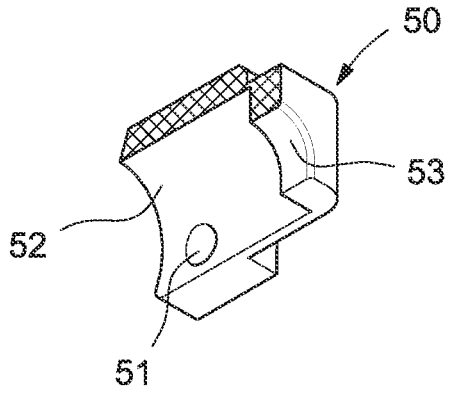
FIG. 7 is a cut-away view of a cam of the crossbow shown in FIG. 5.
Figure 8:
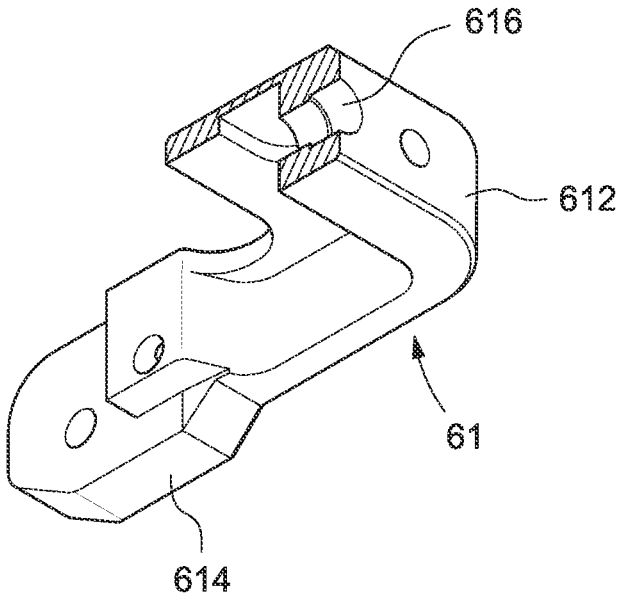
FIG. 8 is a cut-away view of a handle of the crossbow shown in FIG. 5.

Referring to FIGS. 3, 5 and 7, the cam 50 is inserted in the recess 33, in contact with the pushers 40. The cam 50 includes two lateral orifices 51, a space 52, an extensive portion 53 and a lobe 54.

One of the lateral orifices 51 is made in a left side of the cam 50. The remaining one of the lateral orifices 51 is made in a right side of the cam 50.

The space 52 is made in the cam 50. The space 52 receives the front section of the tube 932 and the connection mechanism 20.

The extensive portion 53 extends from the cam 50, before the space 52. The extensive portion 53 of the cam 50 is inserted in the gap 22 of the connection mechanism 20. Selectively, the extensive portion 53 of the cam 50 is in contact with the head of the threaded bolt 26.

Referring to FIGS. 1 to 3, 5, 8 and 9, the handle assembly 60 includes a handle 61, a cocking stirrup 62 and a spring-biased detent 63. The handle assembly 60 is pivotally connected to the mount 30 and the cam 50. Thus, the handle assembly 60 is operable to move the cam 50 relative to the mount 30.

The handle 61 is an inverted U-shaped element including two levers 614, a grip 612 formed between the levers 614, and an aperture 616 made in the grip 612. A pin 64 is fitted in each of the lateral apertures 34 through an aperture 610 made in each of the levers 614 so that the handle 61 is pivotally connected to the mount 30. A pin 66 is fitted in each of the lateral orifices 51 through an aperture 618 made in each of the levers 614 so that the handle 61 is pivotally connected to the cam 50. The aperture 616 extends parallel to the barrel 11 when the handle 61 is connected to the mount 30 and the riser 13 is connected to the barrel 11.

The cocking stirrup 62 includes a connective portion (not numbered), two apertures 622 in the connective portion, an aperture 624 in the connective portion, and a tread 626 located opposite to the connective portion. The aperture 624 is located between the apertures 622. A screw A is inserted the grip 612 through each of the apertures 622 so that the cocking stirrup is connected to the handle 61. Now, the aperture 624 is in communication with the aperture 616. A user can set a foot on the tread 626 while pulling the string 14.

Referring to FIGS. 5 and 9, the spring-biased detent 63 includes a latch 632, a spring 634 and a knob 636. The spring 634 is inserted in the aperture 624. The latch 632 includes a section extending through the spring 634 and the aperture 626. The knob 636 is engaged with the section of the latch 632. The spring 634 is compressed between a shoulder formed on the latch 632 and a shoulder formed between two sections of the aperture 624 so that the spring 634 biases the latch 632 away from the cocking stirrup 62. Selectively, a tip of the latch 632 is inserted in the front aperture 32 to keep the handle assembly 60 in position relative to the mount 30.

Referring to FIG. 9, to detach the riser 13 and the limbs 16 from the barrel 11, the knob 636 is operated to move the latch 632 out of the front aperture 32 of the mount 30.

Figure 10:
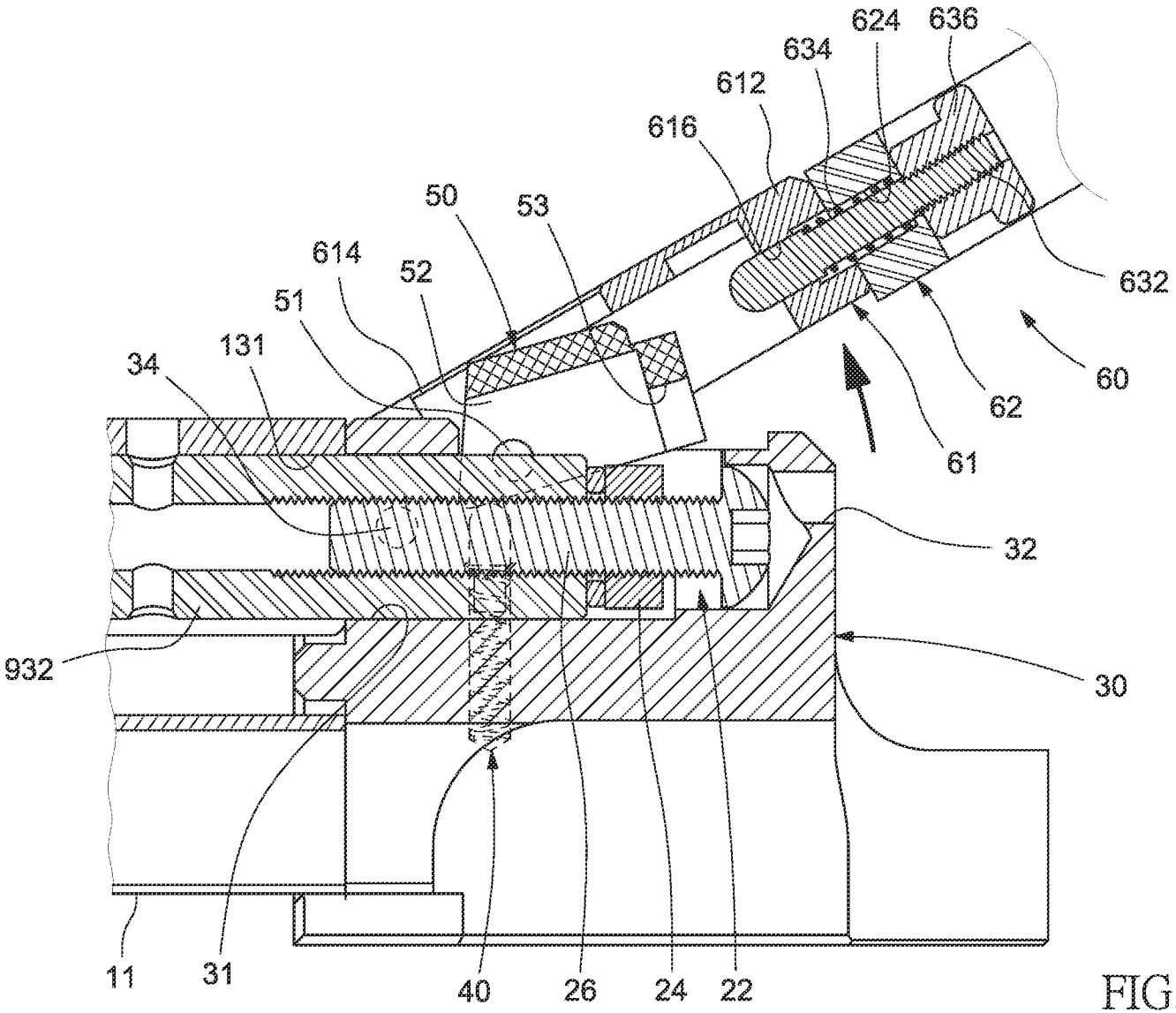
FIG. 10 is a cross-sectional view of the crossbow in another position than shown in FIG. 9.

Then, referring to FIG. 10, the handle assembly 60 is pivoted relative to the mount 30, away from the barrel 11. The handle assembly 60 moves the cam 50 in the recess 33 of the mount 30 due to the connection of the handle assembly 60 to both the mount 30 and the cam 50. Thus, the extensive portion 53 of the cam 50 is moved out of the gap 22 of the connection mechanism 20.

Figure 11:
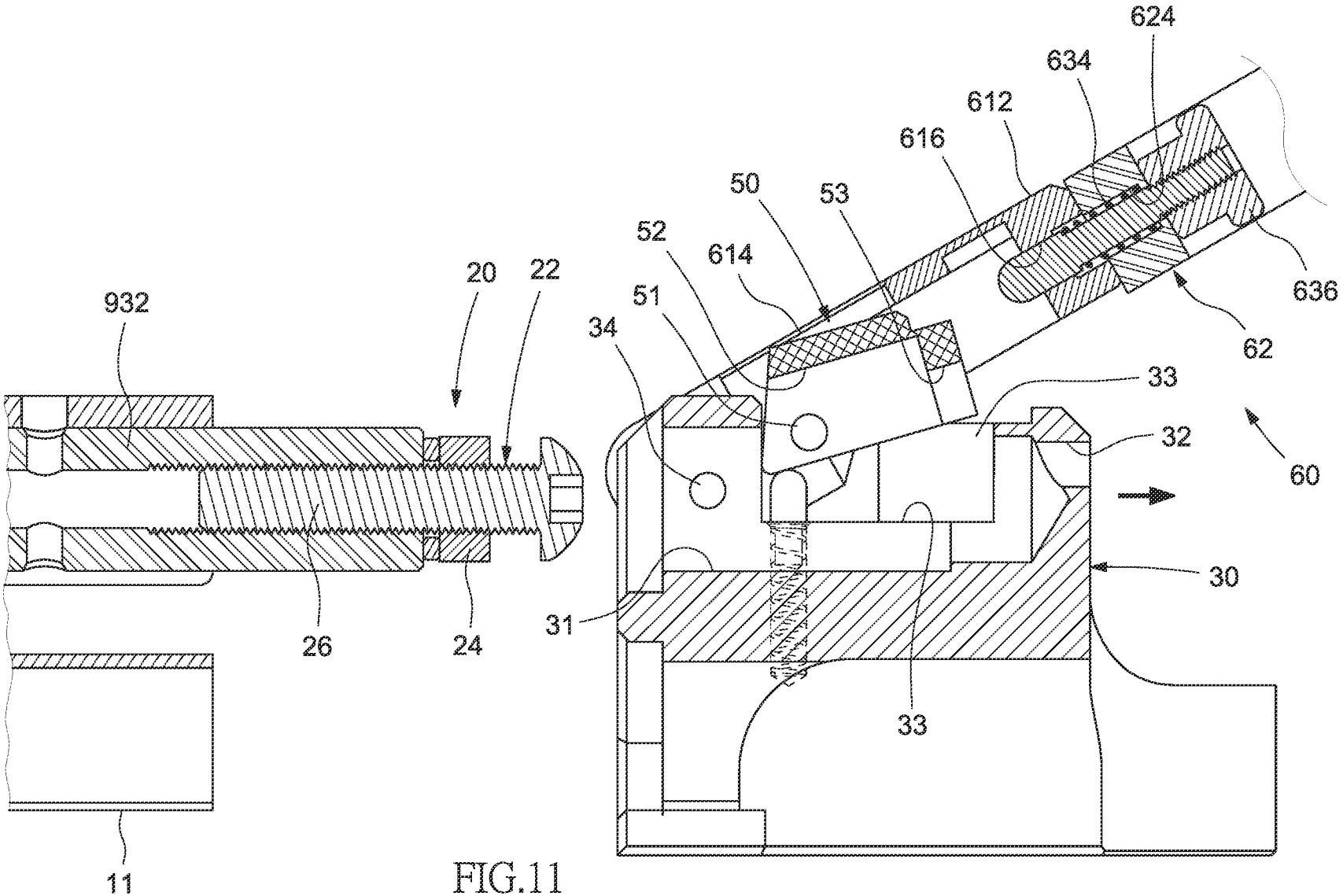
FIG. 11 is a cross-sectional view of the crossbow in another position than shown in FIG. 10.

Then, referring to FIG. 11, the tube 932 and the connection mechanism 20, which are connected to the front end of the barrel 11, are moved out of the rear aperture 31 of the mount 30. Finally, the riser 13 and the limbs 16 are detached from the barrel 11. Now, the crossbow can easily be stored or carried.

Figure 12:
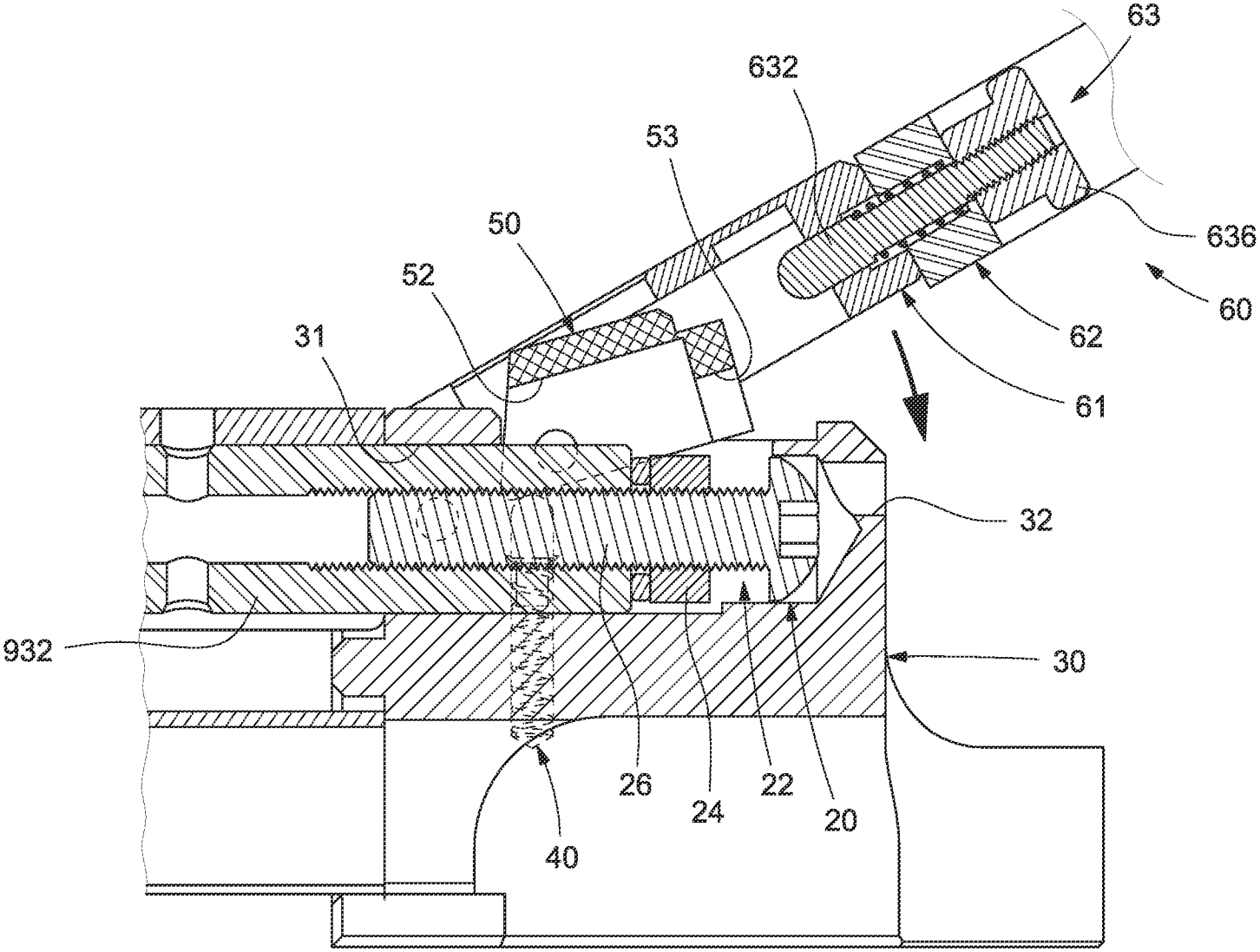
FIG. 12 is a cross-sectional view of the crossbow in another position than shown in FIG. 11.

Referring to FIG. 12, to connect the riser 13 and the limbs 16 to the barrel 11, the tube 932 and the connection mechanism 20 are inserted in the rear aperture 31 of the mount 30. Then, the handle assembly 60 is pivoted toward the mount 30. The handle assembly 60 moves the cam 50 in the recess 33 of the mount 30.

Figure 13:
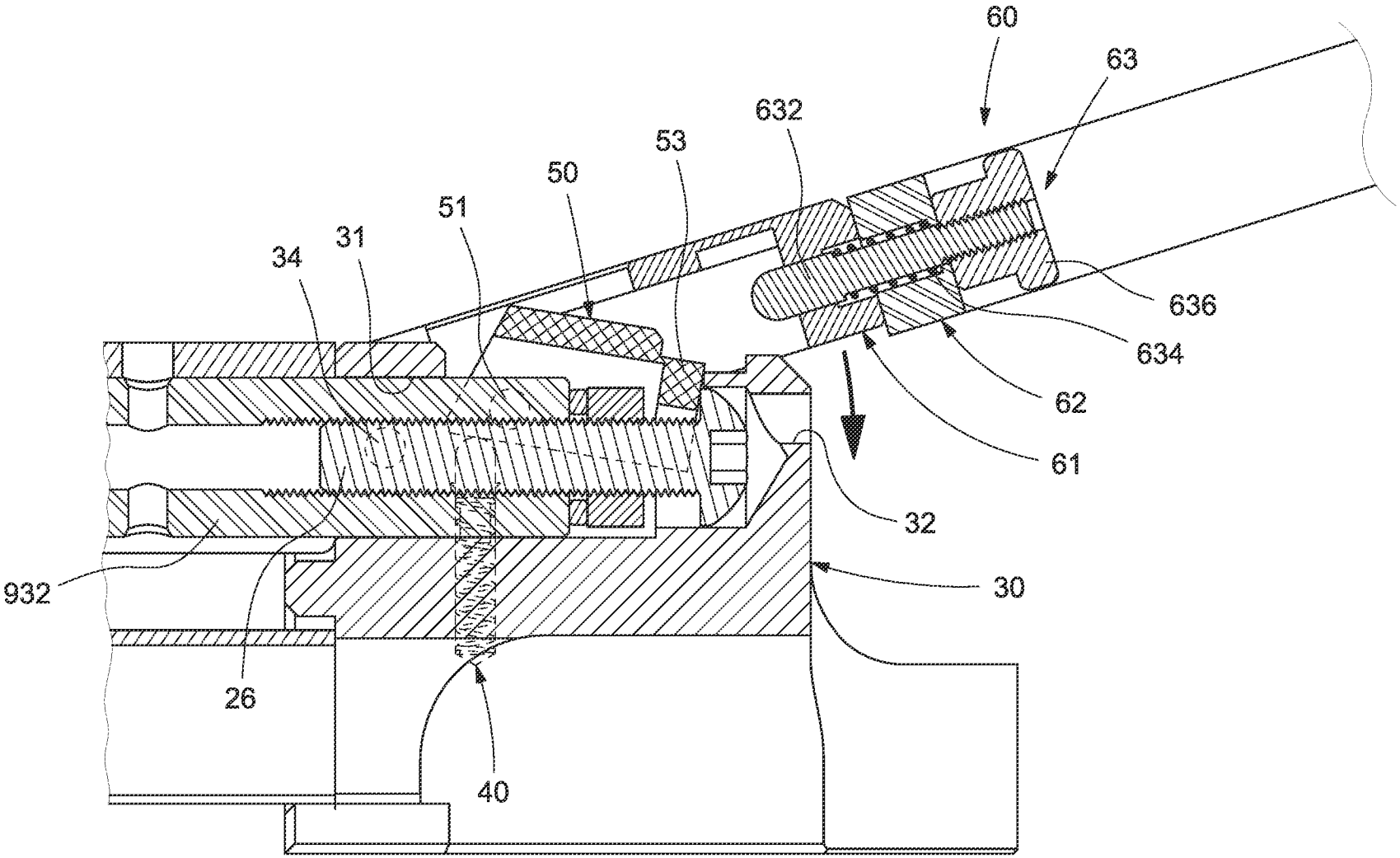
FIG. 13 is a cross-sectional view of the crossbow in another position than shown in FIG. 12.

Referring to FIG. 13, the cam 50 is pushed by the pushers 40 so that the cam 50 is pivoted about the pins in the lateral orifices 51. Thus, a rear end of the cam 50 is located higher than a front end of the cam 50. Friction against the movement of the cam 50 is reduced. Noise caused by the movement of the cam 50 is also reduced.

Figure 14:
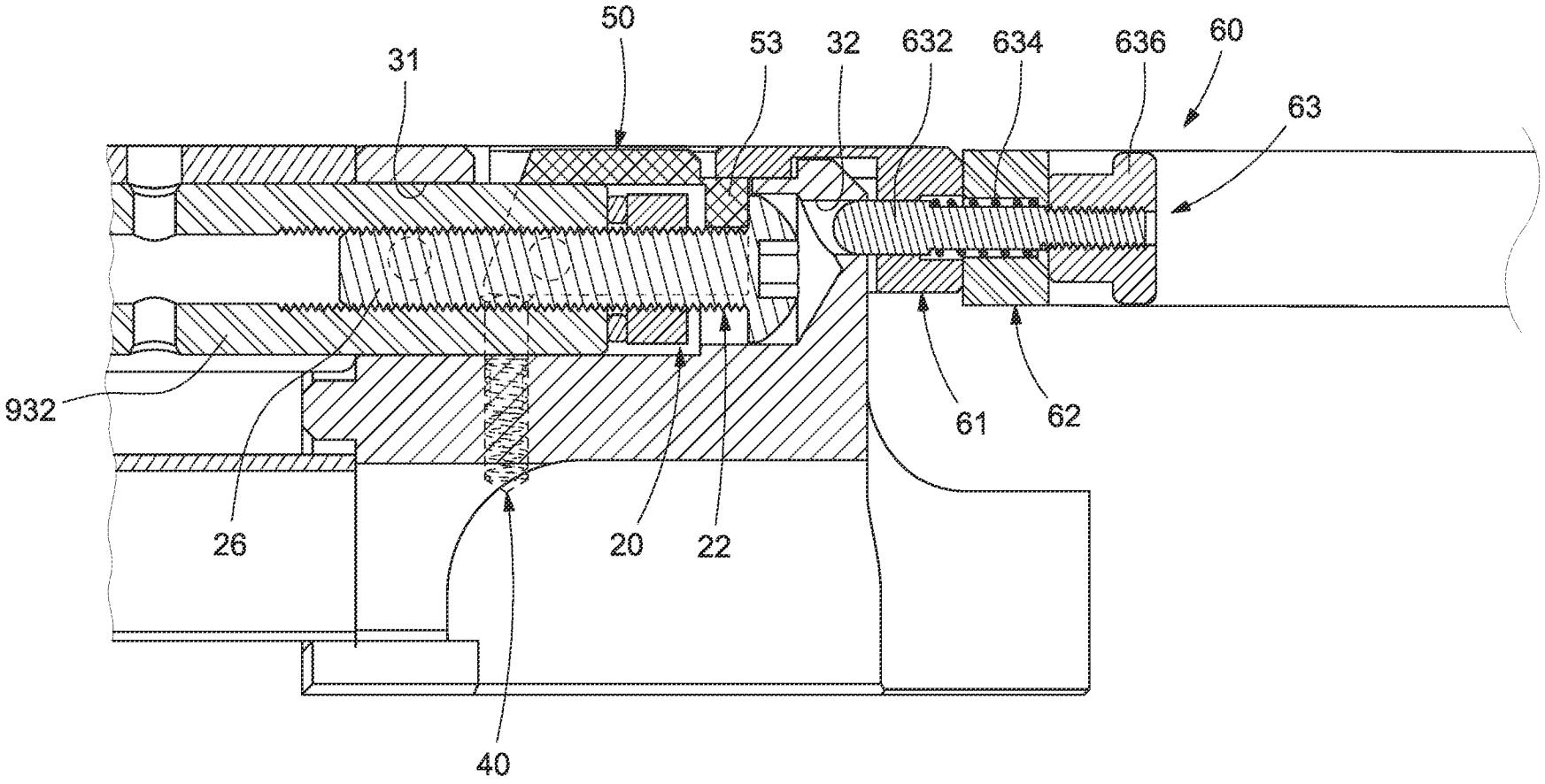
FIG. 14 is a cross-sectional view of the crossbow in another position than shown in FIG. 13.
Figure 15:
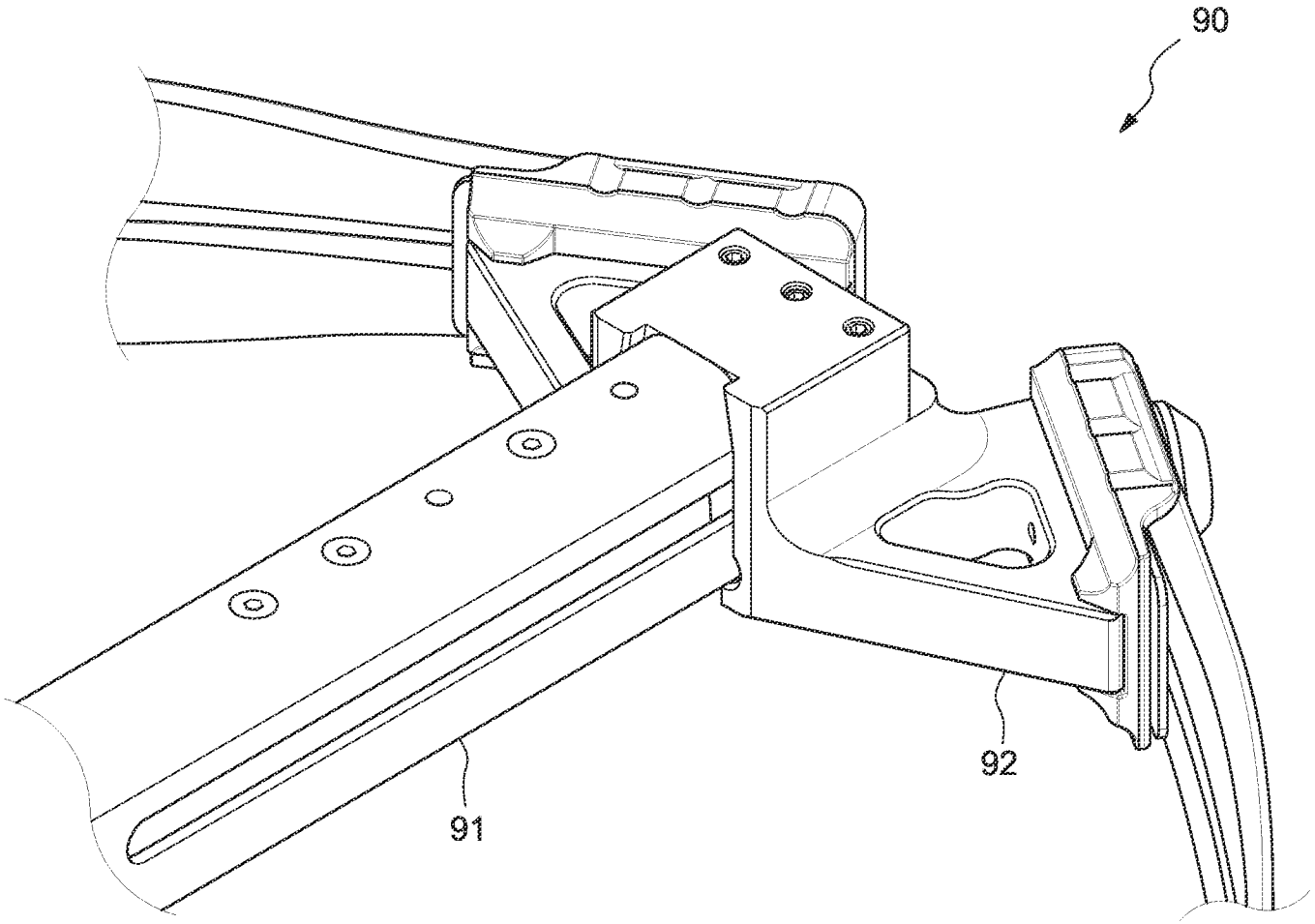
FIG. 15 is a partial view of a conventional crossbow.

Then, referring to FIG. 14, the handle assembly 60 moves the cam 50 toward the mount 30, against the pushers 40. Thus, the extensive portion 53 of the cam 50 is inserted in the gap 22 of the connection mechanism 20. The lobe 54 abuts against the rear protuberance of the mount 30 to press the extensive portion 53 of the cam 50 against the head of the threaded bolt 26. Now, the riser 13, on which the mount 30 is formed, cannot be moved along the tube 932. Moreover, the tip of the latch 632 is inserted in the front aperture 32 of the mount 30 to keep the extensive portion 53 of the cam 50 abutted against the head of the threaded bolt 26, i.e., keep the riser 13 and the limbs 16 connected to the barrel 11.

It should be noted that the tip of the latch 632 is brought into contact with the slope 302 of the mount 30 between the positions shown in FIGS. 13 and 14. The tip of the latch 632 slides on the slope 302 of the mount 30 and the latch 632 retreats into the aperture 616 as the handle assembly 60 is pivoted toward the mount 30. Once the tip of the latch 632 moves beyond the slope 302 of the mount 30, the tip of the latch 632 enters the front aperture 32 of the mount 30.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A crossbow comprising:
a barrel;
a tube connected to the barrel;
a threaded bolt formed with a head and engaged with the tube to provide a gap between the head and the tube;
a riser;
a mount extending from the riser and comprising:
a rear aperture for receiving the tube; and
a recess for receiving the tube and the threaded bolt so that the gap is located in the recess;
a cam movable in the recess and formed with an extensive portion and a space for receiving the tube;
a handle assembly pivotally connected to the mount and the cam so that the handle assembly is operable to move the cam in the recess of the mount to insert the extensive portion of the cam in the gap to keep the connection mechanism in the rear aperture,
wherein the mount further comprises a front aperture, and wherein the handle assembly comprises a spring-biased detent for insertion in the front aperture to keep the handle assembly in position relative to the mount,
wherein the handle assembly comprises:
a handle comprising two levers and a grip formed between the levers, wherein each of the levers is pivotally connected to the mount and the cam; and
a cocking stirrup comprising a connective portion connected to the grip, wherein the spring-biased detent is connected to the connective portion of the cocking stirrup, and
wherein the grip comprises an aperture, wherein the connective portion of the cocking stirrup comprises an aperture in communication with the aperture of the grip, wherein the spring-biased detent comprises:
a latch for insertion in the front aperture of the mount through the aperture of the grip;
a spring comprises between a portion of the latch and the connective portion of the cocking stirrup; and
a knob connected to the latch and operable to move the latch out of the front aperture of the mount.

2. The crossbow according to claim 1, wherein the cam comprises a rear protuberance, wherein the rear aperture is made in the rear protuberance, wherein the cam comprises a lobe for abutment against the rear protuberance to press the extensive portion of the cam against the head of the threaded bolt.

3. The crossbow according to claim 1, further comprising a nut engaged with threaded bolt and abutted against the tube to adjust the gap.

4. The crossbow according to claim 1, further comprising two pins for pivotally connecting the levers to the cam.

5. The crossbow according to claim 4, wherein each of the levers comprises an aperture, wherein the cam comprises two lateral apertures, wherein each of the pins is fitted in a corresponding one of the lateral apertures of the cam through the aperture of a corresponding one of the levers.

6. The crossbow according to claim 1, wherein the cocking stirrup comprises a tread located opposite to the connective portion of the cocking stirrup.

7. The crossbow according to claim 1, wherein the mount comprises a slope for pushing the spring-biased detent when the handle assembly is pivoted toward the barrel, wherein the spring-biased detent enters the front aperture of the mount once the spring-biased detent moves beyond the slope.

8. A crossbow comprising:
a barrel;
a tube connected to the barrel;
a threaded bolt formed with a head and engaged with the tube to provide a gap between the head and the tube;
a riser;
a mount extending from the riser and comprising:
a rear aperture for receiving the tube; and
a recess for receiving the tube and the threaded bolt so that the gap is located in the recess;
a cam movable in the recess and formed with an extensive portion and a space for receiving the tube;
a handle assembly pivotally connected to the mount and the cam so that the handle assembly is operable to move the cam in the recess of the mount to insert the extensive portion of the cam in the gap to keep the connection mechanism in the rear aperture,
wherein the mount further comprises a front aperture, and wherein the handle assembly comprises a spring-biased detent for insertion in the front aperture to keep the handle assembly in position relative to the mount; and
a pusher connected to the mount, wherein the pusher is operable to push the cam and hence bring the extensive portion of the cam into contact with the head of the threaded bolt when the handle assembly is at a certain angle from the barrel.

9. The crossbow according to claim 8, wherein the mount comprises a bore for receiving the pusher.

10. The crossbow according to claim 9, wherein the pusher comprises a spring inserted in the bore of the mount and a rod biased into contact with the cam by the spring.

* * * * *